United States Patent [19]

Fujiwara et al.

[11] 4,330,331

[45] May 18, 1982

[54] ELECTRIC CONTACT MATERIAL AND METHOD OF PRODUCING THE SAME

[75] Inventors: Koichi Fujiwara; Goro Yamauchi; Kishio Arita; Shigeyuki Tsurumi, all of Mito, Japan

[73] Assignee: Nippon Telegraph and Telephone Public Corporation, Tokyo, Japan

[21] Appl. No.: 252,898

[22] Filed: Apr. 10, 1981

Related U.S. Application Data

[62] Division of Ser. No. 47,104, Jun. 11, 1979, Pat. No. 4,279,649.

[51] Int. Cl.[3] ..... C22C 5/00

[52] U.S. Cl. ..... 148/2; 75/206; 427/126.5; 148/431

[58] Field of Search ..... 75/173 A, 206; 148/6.3; 427/126.5

[56] References Cited

U.S. PATENT DOCUMENTS

| | | | |
|---|---|---|---|
| 2,861,155 | 11/1958 | Farnham et al. | 75/173 A |
| 3,258,829 | 7/1966 | Gwyn, Jr. | 148/6.3 |
| 3,515,542 | 6/1970 | Larsen | 75/164 |
| 3,811,876 | 5/1974 | Harigaya et al. | 75/173 R |
| 4,124,380 | 11/1978 | Youdelis | 75/173 R |
| 4,131,458 | 12/1978 | Satoh et al. | 75/173 R |
| 4,150,982 | 4/1979 | Shibata | 75/173 R |
| 4,279,649 | 7/1981 | Fujiwara et al. | 75/173 R |

FOREIGN PATENT DOCUMENTS

| | | |
|---|---|---|
| 2639107 | 3/1978 | Fed. Rep. of Germany . |
| 37-11401 | 8/1962 | Japan . |
| 52-20288 | 2/1977 | Japan . |
| 52-30217 | 3/1977 | Japan . |
| 52-148420 | 12/1977 | Japan . |
| 909349 | 10/1962 | United Kingdom . |

*Primary Examiner*—Veronica O'Keefe

*Attorney, Agent, or Firm*—Burns, Doane, Swecker & Mathis

[57] ABSTRACT

An electrical contact material and method of producing the same are provided. The material is an internally oxidized silver eutectic alloy system with a main component of silver to which at least one of silicon and germanium is added and, for characteristic improvement purpose, at least one selected from at least one of the groups consisting respectively of gold, platinum and the like, titanium, rhenium and the like, and iron, cobalt and the like is further added. In producing the material, an ingot of said alloy is hot-worked and then internally oxidized at a temperature in a range from 250° C. to the eutectic temperature of the alloy.

19 Claims, 9 Drawing Figures

STICKING COEFFICIENT
(SEPARATING FORCE/CONTACTING FORCE)
A
B
C
$10^{-10}$
$10^{-9}$
$10^{-4}$
$10^{-3}$
$10^{-2}$
$10^{-1}$
1
10
OXYGEN EXPOSURE (Torr·sec)

STICKING COEFFICIENT
0.8
0.6
0.4
0.2
0
0 1 2 5 10 15 16 17 18 19 20
Si CONCENTRATION (at %)

CONTACT RESISTANCE (m Ω)
100
50
0
0 1 2 5 10 15 16 17 18 19 20
Si CONCENTRATION (at %)

EROSION OF POSITIVE ELECTRODE (μm)
50
40
30
20
10
0
0 2 4 6 8 10 12 14 16 18
Ge CONCENTRATION (at %)

INITIAL VALUE
1at%Si
10at%Si
17at%Si
I / Rc (Ω)
4
3
2
1
0
0 2 4 6 8 10
Au ADDITION (at %)

ELECTRIC CONTACT MATERIAL AND METHOD OF PRODUCING THE SAME

This is a division, of Application Ser. No. 47,104, filed June 11, 1979, U.S. Pat. No. 4,279,649.

This invention relates to electrical contact materials and, more particularly, to an electrical contact material high in the sticking resistivity, contact resistance property, erosion resistivity and corrosion resistivity, as well as to a method of producing the said material.

There have been known rhodium-plated contact material and gold-plated diffusion contact material, which are the ones developed to prevent the trouble of inability to separate opposing contactors from each other due to sticking between them which is a problem particularly in switches sealed in such inert gas as nitrogen. In this sense, they are high in the sticking resistivity but have defects that, in case they are used under low contacting force conditions, the contact resistance will increase to be more than 1 Ω even within pure nitrogen and that, as rhodium and gold are costly, producing costs for them as of the electrical contact materials are also high.

Conventional internally oxidized alloys for electrical contact materials are made through internal oxidation of α-type solid solution. Typical one of them is internally oxidized silver-cadmium alloy, which is known to be high in the welding resistivity but has such defect that the contact resistance is remarkably high under low contact force and light load conditions. This is because, not only in the internally oxidized silver-cadmium alloy but also in any α-type solid solution internally oxidized alloy, the internal oxidization is caused by the diffusions of oxygen from the material surface and of the solute element toward the material surface, so that dispersing state of the oxide becomes coarser from the surface towards the depth direction and the contact properties are deteriorated by mechanical wear or erosion due to spark discharges. In addition, this internally oxidized α-type solid solution alloy requires a longer oxidation time and higher production cost.

There is also known a contact material wherein oxide particles and basic metal are consolidated by a sintering method to uniformly disperse the oxide particles in the basic metal. However, it is difficult to uniformly disperse the fine oxide particles with less than several μm in diameter required for the contact materials which are used under low contact force conditions. In addition, it is lower in the density than a bulk material to render the mechanical property to be remarkably low and the manufacture of film to be difficult.

Further, in the case where silver contact is employed in a circuit network involving discharges at the time of contact close, it shows anode arc erosion with a deep pit.

The present invention has been suggested to remove such defects as described above of the conventional contact materials.

A primary object of the present invention is to provide an electrical contact material high in the sticking resistivity, contact resistance property, errosion resistivity, corrosion resistivity and welding resistivity, as well as a method of producing such material.

Another object of the present invention is to provide an electrical contact material effective to render the electric switches to be small, their manufacturing cost to be low, their life to be long and their reliability to be high.

The other objects and advantages of the present invention shall become clear from the following detailed description of the invention.

Definitions of the respective terms such as the sticking resistivity, contact resistance property, corrosion resistivity and welding resistivity used in the description are as follows:

The "sticking resistivity" is represented by a sticking coefficient (separating force/contacting force) in an ultra-high vacuum of $5\times10^{-10}$ Torr after the contact is bombarded with argon ions and is cleaned on the surface. The "contacting force" here means a force required to bring respective contactors into contact with each other. The "separating force" means a force required to separate the contacting contactors from each other.

The "contact resistance property" is represented by a contact resistance after the contact material is mounted on a wire spring relay and is driven two million times under non-load conditions in the atmosphere.

The "erosion resistivity" is represented by an erosion depth in the contactors after the contact is mounted on a wire spring relay and the contactors are operated 100 thousand times with the discharges performed when they are closed by means of an RC discharge circuit (R=20 Ω and C=0.22 μF) under an impressed voltage of 48 V.

The "corrosion resistivity" is represented by a contact resistance when the contact material is treated for 3 hours at the room temperature in artificial air of a humidity of 90% containing 10 ppm. of $H_2S$ and is then measured under a contacting force of 5 g. using a hemispherical gold rivet of a radius of 0.5 mm., or is treated as left for 48 hours at the room temperature in artificial air of a humidity of 90% containing 10 ppm. of $SO_2$ and is then measured under a contacting pressure of 5 g.

The "welding resistivity" is represented by a presence or absence of a trouble of inability to separate the contactors sticked to each other due to welding between them during contact operations of $10^4$ times while passing an electric current of 30 V and 30 A through the contact.

According to the present invention, an electrical contact material obtained by internally oxidizing a silver eutectic alloy system containing at least an element selected from the group consisting of Si and Ge at a total solution concentration of 1 to 17 at. %, the rest being silver.

Further according to the present invention, an electrical contact material obtained by internally oxidizing a silver eutectic alloy system containing at least one element selected from the group consisting of Si and Ge at a total solution concentration of 1 to 17 and, as a first additive element, 1 to 10 at. % of at least one element selected from the group consisting of Au, Pt, Pd, Rh, Ru, Os and Ir, the rest being Ag, is provided.

Still further according to the present invention, an electrical contact material obtained by internally oxidizing a silver eutectic alloy system containing at least one element selected from the group consisting of Si and Ge at a total solution concentration of 1 to 17 at. % and, as a second additive element, 1 to 5 at. % of at least one element selected from the group consisting of Ti, V, Zr, Nb, Mo, Ta, W and Re, the rest being Ag, is provided.

According to the present invention, an electrical contact material is provided by adding to Ag at least one element selected from the group consisting of Si and Ge at a total solution concentration of 1 to 17 at. %, a first additive element of 1 to 10 at. % of at least one element selected from the group consisting of Au, Pt, Pd, Rh, Ru, Os and Ir, and a second additive element of 1 to 5 at. % of at least one element selected from the group consisting of Ti, V, Zr, Nb, Mo, Ta, W and Re.

Further according to the present invention, an electrical contact material is provided by adding to Ag at least one element selected from the group consisting of Si and Ge at a total solution concentration of 1 to 17 at. % and a third additive element of 1 to 5 at. % of at least one element selected from the group consisting of Fe, Co, Ni and Cu.

Yet further according to the present invention, an electrical contact material obtained by internally oxidizing a silver eutectic alloy system containing at least one element selected from the group consisting of Si and Ge at a total solution concentration of 1 to 17 at. %, a first additive element of 1 to 10 at. % of at least one element selected from the group consisting of Au, Pt, Pd, Rh, Ru, Os and Ir, and a third additive element of 1 to 5 at. % of at least one element selected from the group consisting of Fe, Co, Ni and Cu, the rest being Ag, is provided.

Preferred embodiments of the present invention shall be explained in the followings with reference to accompanying drawings, in which.

Figure 3:
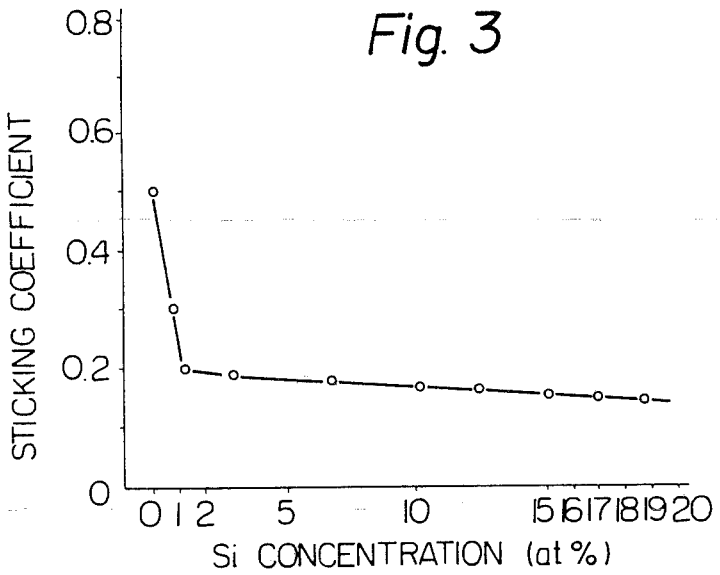
Figure 4:
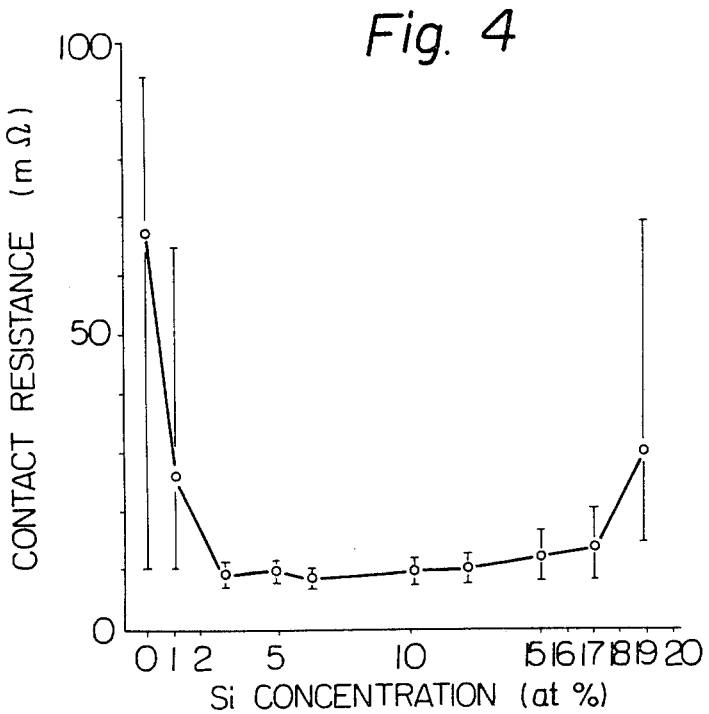
Figure 5:
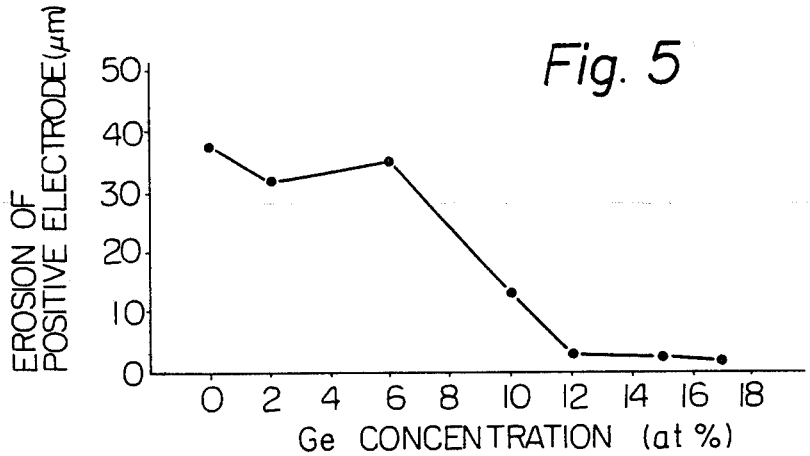
Figure 6:
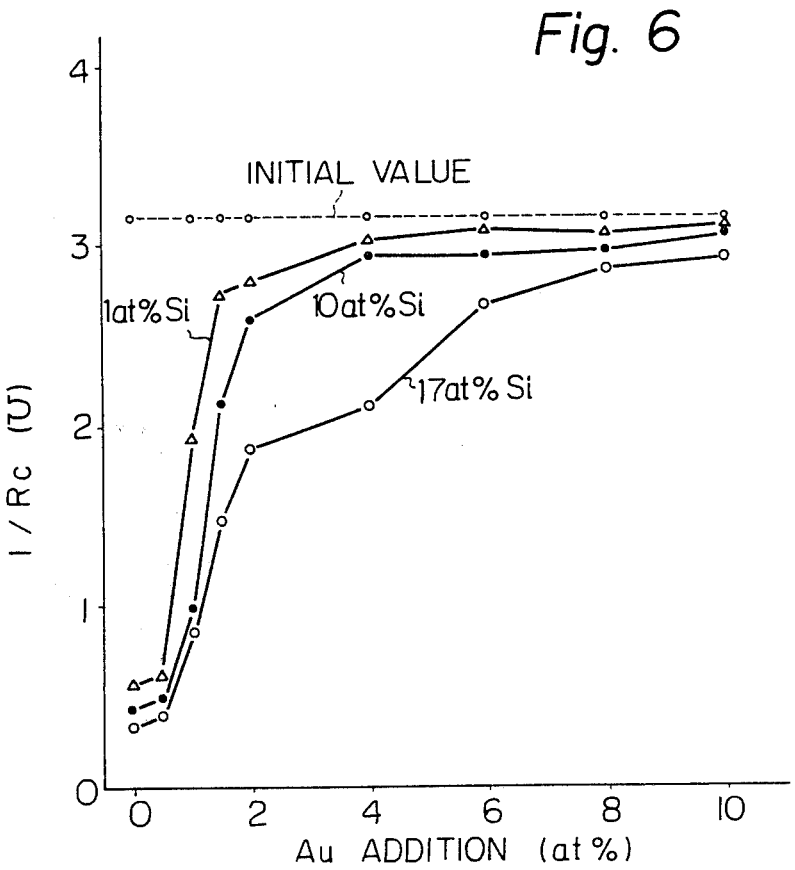

FIG. 3 diagrammatically shows the sticking characteristic;

FIG. 4 shows diagrammatically the contact resistance property of the material according to the present invention;

FIG. 5 shows diagrammatically the erosion of anode due to discharge arcs of the material according to the present invention; and FIG. 6 shows further diagrammatically results of corrosion resistivity tests under different conditions of the material according to the present invention.

Figure 1:
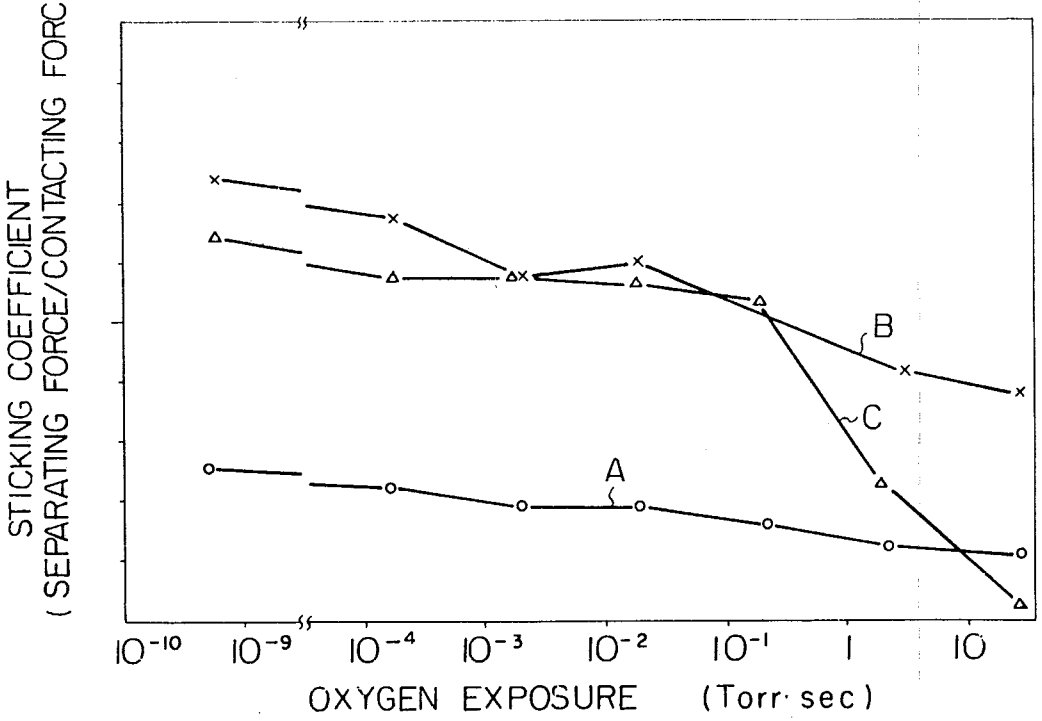
FIG. 1 shows diagrammatically the sticking resistivity of the material according to the present invention in comparison with those of conventional materials.
Figure 2B:
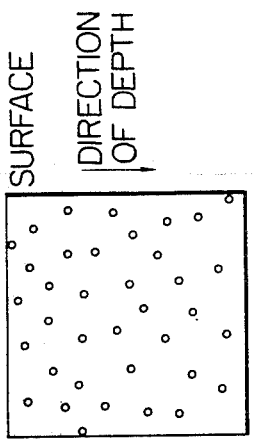
FIG. 2 shows schematically metallographical structures of the material of the present invention and a silver-cadmium oxide alloy.
Figure 2B:
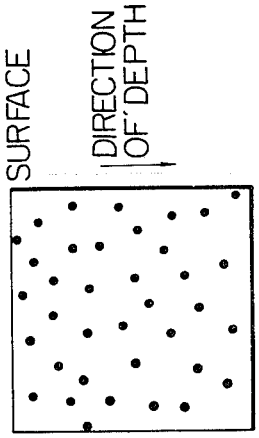
Figure 2A:
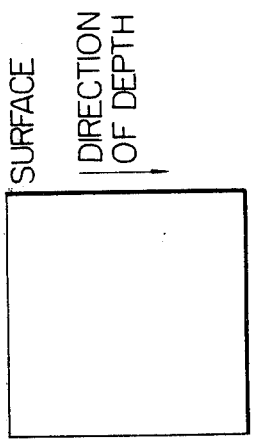
Figure 2A:
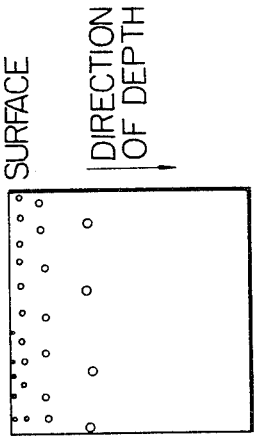

Referring to FIG. 1 showing the sticking resistivity of the electrical contact material according to an embodiment of the present invention, a curve A represents the sticking resistivity of the electrical contact material by the present invention, a curve B represents the resistivity of a silver—7.8 at. % silicon alloy and a curve C represents the resistivity of a palladium contact material.

The sticking coefficient of the electrical contact material according to the present invention is 0.25 even in the case of a clean surface in an ultra-high vacuum which is the severest condition for the evaluation of the sticking resistivity, and it is seen that the coefficient is reduced to be $\frac{1}{8}$ that of the other samples which are not internally oxidized. Generally, in a sealed switch, it is considered from the structure that, unless the sticking coefficient is less than 0.5, the material involves the risk of sticking trouble. Therefore, whereas the sticking coefficient of non internally oxidized silver—8 at. % silicon alloy as well as palladium which has been practically used as a communication material for many years will be less than 0.5 only when a fixed amount of oxygen is present, a very high sticking resistivity is shown in the case of the electrical contact material according to the present invention even if no oxygen is present.

Referring next to FIG. 2 which shows schematically metallographical structures of the electrical contact material according to the present invention and a known material of internally oxidized silver—12 at. % cadmium, respective circles indicate solute element particles and respective dots indicate oxide particles. In the case of the internally oxidized silver—12 at. % cadmium oxide, cadmium is not recognized to be deposited as shown in FIG. 2A before the internal oxidation, as cadmium is in the $\alpha$-phase, but after the internal oxidization treatment, cadmium is gradually coarsely dispersed toward the central portion from the sample surface as shown in FIG. 2A'. Under the conditions of 800° C. for 60 minutes in the atmosphere, the internally oxidized layer was only about 12 $\mu$m thick. On the other hand, in the case of the electrical contact material according to the present invention, as shown in FIG. 2B, silicon are already uniformly finely dispersed in silver even before the internal oxidization and such uniform dispersion is changed little even after the internal oxidation treatment, while only silicon is oxidized in the surface layer of the particles as shown in FIG. 2B'.

In case the amount of addition of silicon is less than 1 at. %, both the contact resistance property and sticking resistivity is substantially equal to those of pure silver and there is no effect of adding silicon. When it is more than 17 at. %, the electrical contact material is difficult to roll or draw. Therefore, the concentration of silicon is proper in the range as defined according to the present invention.

The sticking resistivity and contact resistance property are shown in FIGS. 3 and 4. The concentration of Si is limited to be 1 to 17 at. %, because at a concentration exceeding 17 at. % even the hot-working is difficult and the initial crystal of silicon at the time of the coagulation becomes so large as to be difficult to fine and uniformly disperse.

FIG. 5 shows the erosion resistivity. Detailed preparation of test pieces used for this diagram is referred to in a later described Example 5.

Results of corrosion resistivity tests performed, using hydrogen sulfide ($H_2S$), with respect to the electrical contact material of the present invention are shown in FIG. 6. With the addition of Au, the corrosion resistivity was recognized to remarkably improve without impairing the sticking resistivity, contact resistance property and erosion resistivity. However, when the amount of addition was less than 1 at. %, any effect of adding Au was not recognized.

Now, an electrical contact material obtained by adding to Ag 1 to 17 at. % of at least one of Ge and Si and, as a first additive element, 1 to 10 at. % of at least one of Au, Pd, Pt, Rh, Ru, Os and Ir and internally oxidized in a temperature range of 250° C. to a eutectic temperature has a remarkable corrosion resistivity even against such corrosive gas as $H_2S$ and, therefore, has an advantage that it can be used as a electrical contact material for the electrical communications in the atmosphere. The concentration of the additive element is limited to be in a range of 1 to 10 at. % of at least one of Au, Pt, Pd, Rh, Ru, Os and Ir, because, when it is less than 1 at. %, no adding effect on the corrosion resistivity is seen and, when it is more than 10 at. %, no internally oxidizing effect is seen, the sticking coefficient will be the same as of a pure metal and no effect of the sticking resistivity can be expected.

In the case of the electrical contact materials for medium currents, a current of 1 to several tens of amperes is passed through them and they are frequently opened and closed while the current is being passed. Therefore, arc discharges is caused and troubles of welding often occurs. Therefore, when a silver eutectic alloy system containing at least one of Si and Ge at a total solution concentration of 1 to 17 at. % contains 1 to 5 at. % of at least one of Ti, V, Zr, Nb, Mo, Ta, W and Re as added Si or Ge being finely dispersed and internally oxidized, a stable characteristic high in the welding resistivity as of a contact material for medium currents can be maintained.

When at least one of Ti, V, Zr, Nb, Mo, Ta, W and Re which are high melting point metals is added as a second additive element, the melting points of the silver eutectic alloy system containing 1 to 17 at. % of at least one of Si and Ge and of the silver eutectic alloy system having 1 to 10 at. % of at least one of Au, Pt, Pd, Rh, Ru, Os and Ir added as a first added element to it is elevated. Therefore, there is an advantage of the elevation of the welding resistivity.

The amount of addition of at least one of Ti, V, Zr, Nb, Mo, Ta, W and Re is limited to be 1 to 5 at. % because, when it is less than 1 at. %, the elevation of the welding resistivity cannot be expected and, when it is more than 5 at. %, the oxide of Ti, V, Zr, Nb, Mo, Ta, W or Re are formed on the surface by the internally oxidizing treatment and the contact resistance is elevated.

The electrical contact material obtained by internally oxidizing the silver eutectic alloy system containing at least one of Si and Ge at a total solution concentration of 1 to 17 at. % or the silver eutectic alloy system having 1 to 10 at. % of at least one of Au, Pt, Pd, Rh, Ru, Os and Ir added as a first additive element to it is so low in the erosion as to be of ½ to 1/5 that of a conventional precious metal contact. In this respect, the above described material is high in the erosion resistivity. However, in case the Si concentration is so low as to be 1 to 7 at. %, the erosion resistivity will be improved to be only about ½ that and, even in case the Si concentration is so high as to be 7 to 17 at. %, no perfectly flat erosion is made in certain cases. Conventionally, the electrical contact material for electric communication has been used in the form of a thin layer clad on a base material of an Fe alloy system, and the thickness of the electrical contact material is determined in view of the depth of erosion occurring in the particular clad layer. If the electrical contact material shows a flat erosion, the contact material can be reduced in the thickness and the contacts can be economized. According to the present invention, for further improvement in the erosion resistivity, the above described material has 1 to 5 at. % of at least one of Fe, Co, Ni and Cu added and is then internally oxidized to maintain a favorable electrical contact characteristic.

The amount of addition of at least one of Fe, Co, Ni and Cu is limited to be 1 to 5 at. % because, when it is less than 1 at. %, no improvement of the erosion resistivity can be expected and, when it is more than 5 at. %, the oxide of Fe, Co, Ni and Cu is formed by the internally oxidizing treatment and the contact resistance rises.

The upper limit of the internally oxidizing temperature is the eutectic temperature of 840° C. of the Ag-Si alloy in case Si is added to Ag, is the eutectic temperature of 651° C. of the Ag-Ge alloy in case Ge is added to Ag and is eutectic temperature of 840° C. of the Ag-Si alloy in case Si and Ge are added to Ag. The lower limit is proper at 250° C. because, at a lower temperature, a long time is required for the internal oxidization.

Examples of the present invention shall be explained in the followings:

Example 1

An ingot having a diameter of 15 mm. and a length of 50 mm. made by adding 7.3 at. % silicon to silver and dissolving them in an argon gas stream was quenched with water and was repeatedly subjected to an annealing at 300° C. for 20 minutes in a vacuum and a drawing at a working rate of 70% so as to be of a diameter of 3 mm. Then this sample was internally oxidized at 800° C. for 60 minutes in the atmosphere to obtain an electrical contact material according to the present invention, in which silicon was granular of a maximum diameter of 2 μm and an average diameter of 0.5 μm and was uniformly dispersed in silver. The sticking resistivity of thus obtained electrical contact material of internally oxidized silver—7.3 at. % silicon alloy according to this example is represented by the curve A in FIG. 1. Therefore, the features set forth with reference to FIG. 1 are all applied to the present example, and it is seen that the internally oxidized silver—7.3 at. % silicon electrical contact material of the present invention proves a remarkably excellent sticking resistivity even in the absence of oxygen, quite in contrast to the electrical contact material of non internally oxidized silver—7.8 at. % silicon alloy.

EXAMPLE 2

By the same producing method as in Example 1, 1 to 17 at. % silicon was added to silver, the sample was made into the form of a tape of 0.2 mm. thick and was internally oxidized at 400° C. for 30 minutes in the atmosphere to obtain an electrical contact material according to the present invention. In the case of this example, the internally oxidizing speed was so high that, even under the internally oxidizing conditions of 400° C. for 30 minutes, the entire sample of 0.2 mm. thick could be internally oxidized.

As regards the sticking resistivity and contact resistance of the thus obtained material, references should be made to FIGS. 3 and 4, respectively. It is clear that the electrical contact material according to the present invention is excellent in both the sticking resistivity and contact resistance as compared with those of silver.

EXAMPLE 3

An ingot of a diameter of 15 mm. and a length of 30 mm. made by adding 5 at. % silicon and 5 at. % germanium to silver and dissolving them in an argon arc dissolving furnace was repeatedly subjected to an annealing at 800° C. for 20 minutes in a vacuum and a rolling at a working rate of 50% to make a plate of 0.2 mm. thick. Then this plate was internally oxidized at 500° C. for 30 minutes in pure oxygen at 1 atmosphere to obtain an electrical contact material according to the present invention. The sticking coefficient of this material was 0.2 and thus the sticking resistivity was improved to be 50% higher than that of a material made by adding only 5 at. % silicon to silver and internally oxidizing them. The contact was less than 80 mΩ and showed a favorable characteristic.

EXAMPLE 4

Six ingots of the same dimensions of a diameter of 20 mm. and a length of 300 mm. but of different compositions as shown in Table 1 were made by adding 10 to 17 at. % Si to Ag and at 1,200° C. Each of them was surface-ground, then worked to be 4 mm. square with hot groove rolls at about 600° C. and hot-rolled to be a plate of 1 mm. thick at about 600° C. The plate was further made to be a sheet of 150 μm. thick by cold-rolling. This sheet was internally oxidized at 800° C. for 1 hour in the atmosphere and then the erosion resistivity of the respective samples was measured.

The results of the measurements are shown in Table 1. It is seen that the materials of the present invention are improved to be twice as high in the erosion resistivity as the conventional materials.

TABLE 1

| | Alloy Composition | Erosion Depth of Anode (μm) |
|---|---|---|
| Conventional Materials | Ag | 80 ± 20 |
| | Ag - 60 % Pd | 40 ± 15 |
| | Internally oxidized Ag - 10.0 at. % Si | 25 ± 10 |
| | Internally oxidized Ag - 12.0 at. % Si | 10 ± 5 |
| Materials of the Present Invention | Internally oxidized Ag - 15.0 at. % Si | 10 ± 5 |
| | Internally oxidized Ag - 17.0 at. % Si | 10 ± 5 |

EXAMPLE 5

An ingot of a diameter of 20 mm. and a length of 300 mm. was made by adding 10 to 17 at. % Ge and at 1,100° C. The ingot was surface-ground, then worked to be 4 mm. square with hot groove rolls at about 300° C., hot-rolled at about 300° C. to be a plate of 2 mm. thick and further cold-rolled to be a sheet of 150 μm thick. This sheet was internally oxidized at 600° C. for 2 hours in the atmosphere and then the erosion resistivity was measured. The results of the measurements are shown in the diagram of FIG. 5.

The electrical contact made with the thus prepared material has shown a stable contact resistance property of less than 50 mΩ and a favorable sticking resistivity of a sticking coefficient of about 0.3.

EXAMPLE 6

TABLE 2

| Si Addition (at. %) | Ge Addition (at. %) | Erosion Depth of Anode (μm) | RC after 1 Million Times Opening & Close (mΩ) | Sticking Coefficient |
|---|---|---|---|---|
| 0.5 | 0.5 | 60 ± 20 | 30 | 0.3 |
| 1.0 | 0 | 50 ± 20 | 30 | 0.3 |
| 0 | 1.0 | 55 ± 20 | 45 | 0.3 |
| 7.0 | 7.0 | 10 ± 5 | 30 | 0.15 |
| 17.0 | 0 | 10 ± 5 | 30 | 0.1 |
| 0 | 17.0 | 10 ± 5 | 35 | 0.1 |
| 8.5 | 8.5 | 10 ± 5 | 35 | 0.1 |

An ingot of a diameter of 20 mm. and a length of 300 mm. was made by adding to Ag each of such amounts of Si and Ge as shown in the above Table 2 at a temperature of 1,200° C., the ingot was surface-ground, then worked at one end to be conical of an apex angle of 60 degrees, annealed at 700° C. for 1 hour, hot-extruded under 3,000 atmospheres and worked to be a wire of a diameter of 4 mm. This wire was further annealed at 600° C. for 30 minutes and then cold-worked to be a sheet of 150 μm thick. Then, in the same manner as in Example 1, the sheet was internally oxidized and mounted on a wire spring relay, and the erosion amount was measured. As a result, as shown in Table 2, the electrical contact made by adding more than 10 to 17 at. % of at least one of Si and Ge was of an erosion depth of about 10 μm at the anode and showed a favorable erosion resistivity. Further, the contact made with the thus prepared material showed a stable contact resistance property of less than 50 mΩ and a favorable sticking resistivity of a sticking coefficient of about 0.2.

EXAMPLE 7

Ingots of a diameter of 10 mm. and a length of 200 mm. were made by adding to Ag 1, 10 and 17 at. % Si, respectively, as a main additive element and 1, 2, 5, 7 and 10 at. % Au, respectively, as a first additive element and dissolving them at 1,200° C. The respective ingots were surface-ground and then hot-worked at 600° C. and cold-worked to be a plate of 0.5 mm. thick. Then the plates were internally oxidized at 800° C. for 30 minutes in the atmosphere to obtain electrical contact materials according to the present invention. Silicon in the electrical contact material according to the present invention was granular of a maximum diameter of 2 μm and an average diameter of 0.5 μm and uniformly dispersed in silver. The dispersed state of silicon in silver of the thus prepared material was substantially the same as that before the internal oxidization but, due to the internal oxidation, the surface of silicon grains was made to be a layer of $SiO_2$.

Reference should be made to the diagram of FIG. 6 showing the corrosion resistivity of the above obtained material and, as has been already described, the corrosion resistivity is remarkably improved by the addition of Au without impairing any other performances of the electrical contact material.

EXAMPLE 8

An electrical contact material of 0.5 mm. thick was made in the same manner as in Example 7 by adding to silver 15 at. % Si as a main additive element and at least one of Au, Pd, Pt, Rh, Ru, Os and Ir as a first additive element at the concentration shown in Table 3 and performing the internal oxidization at 500° C. for 1 hour in the atmosphere. The results of corrosion resistivity tests performed with respect to the electrical contact material with a pressure of $SO_2$ are shown in Table 3. In these results, it is shown that, in the case of the electrical contact materials to which no first additive element was added, the contact resistance $R_c$ exceeded 1Ω for a contacting force of 5 g., whereas the electrical contact materials having had the first additive element added (the amount of addition is shown in at. %) all were of less than 1Ω and showed stabilized characteristics. The other characteristics were not impaired by the addition of the first additive element.

TABLE 3

| Sample No. | Au | Pd | Pt | Rh | Ru | Os | Ir | RC (mΩ) |
|---|---|---|---|---|---|---|---|---|
| 1 | 5 | — | — | — | — | — | — | 150 |
| 2 | — | 10 | — | — | — | — | — | 120 |
| 3 | — | — | 10 | — | — | — | — | 115 |
| 4 | — | 3 | — | 1 | — | — | — | 210 |
| 5 | — | 3 | — | — | 1 | — | — | 205 |
| 6 | — | 3 | — | — | — | 1 | — | 200 |

TABLE 3-continued

| Sample No. | Au | Pd | Pt | Rh | Ru | Os | Ir | RC (mΩ) |
|---|---|---|---|---|---|---|---|---|
| 7 | — | 3 | — | — | — | — | 1 | 205 |

EXAMPLE 9

A bar of a diameter of 2 mm. and a length of 10 mm. was made by adding to Ag 10 at. % Si and then Au, Pt, Pd, Rh, Ru, Os and Ir at the respective concentrations (in at. %) shown in Table 4 and dissolving and working them in the same manner as in Example 7 and was further internally oxidized at 600° C. for 2 hours in the atmosphere to obtain an electrical contact material high in the corrosion resistivity and sticking resistivity. The sticking coefficient and corrosion resistivity in case $SO_2$ is used are shown in Table 4. Pd that has been practically used for many years shows a sticking coefficient of 0.65 in an ultra-high vacuum and is likely to cause a sticking trouble but the electrical contact material according to the present invention shows a sticking coefficient less than 0.5 as shown in Table 4 and is found to be a material high in the sticking characteristic. However, when the amount of addition of at least one of Au, Pt, Pd, Rh, Ru, Os and Ir exceeds 10 at. %, the diffusion of oxygen into the alloy becomes difficult, the effect of the internal oxidization is lost and the improvement of the sticking characteristic cannot be expected.

TABLE 4

| Sample No. | Au | Pt | Pd | Rh | Ru | Os | Ir | Contact Resistance (mΩ) | Sticking Coefficient |
|---|---|---|---|---|---|---|---|---|---|
| 1 | 5 | — | — | — | — | — | — | 150 | 0.2 |
| 8 | 10 | — | — | — | — | — | — | 90 | 0.5 |
| 9 | 1 | — | 1 | — | — | — | — | 300 | 0.1 |
| 10 | 2 | — | 2 | — | — | — | — | 160 | 0.2 |
| 11 | 5 | — | 5 | — | — | — | — | 95 | 0.5 |
| 3 | — | 10 | — | — | — | — | — | 115 | 0.5 |
| 12 | 5 | — | 2 | 1 | — | — | — | 100 | 0.4 |
| 13 | 5 | — | 2 | — | 1 | — | — | 100 | 0.4 |
| 14 | 5 | — | 2 | — | — | 1 | — | 100 | 0.4 |
| 15 | 5 | — | 2 | — | — | — | 1 | 100 | 0.4 |

EXAMPLE 10

Ingots were made in the same manner as in Example 7 by making two different alloys by adding to Ag 7 at. % of each of Si and Ge and 1 at. % of each of Rh, Ru, Os and Ir, worked to be in the form of tape of 0.2 mm. thick by hot-rolling and then cold-rolling, and the tapes were then internally oxidized at 400° C. for 30 minutes in the atmosphere to obtain electrical contact materials of such compositions as in Table 5.

TABLE 5

| Sample No. | Si | Ge | Rh | Ru | Os | Ir | Contact Resistance (mΩ) |
|---|---|---|---|---|---|---|---|
| 16 | 7 | — | 1 | — | — | — | 21 |
| 17 | 7 | — | — | 1 | — | — | 21 |
| 18 | 7 | — | — | — | 1 | — | 20 |
| 19 | 7 | — | — | — | — | 1 | 22 |
| 20 | — | 7 | 1 | — | — | — | 31 |
| 21 | — | 7 | — | 1 | — | — | 30 |
| 22 | — | 7 | — | — | 1 | — | 30 |
| 23 | — | 7 | — | — | — | 1 | 31 |

As a result of investigating the contact resistance, the contact resistance was found to be about 20 to 30 mΩ in each contact and showed a very stable contact resistivity. In this case, the number of drives by a wire spring relay was 10 million times.

EXAMPLE 11

An ingot of a diameter of 20 mm. and a length of 300 mm. was made by adding to Ag 3 at. % of each of Si and Ge and 2% of each of Au and Pd, surface-ground, worked at one end to be conical of an apex angle of 60 degrees, annealed at 650° C., for 1 hour, then hot-extruded under 3,000 atmospheres and worked to be a wire of a diameter of 4 mm. This wire was further annealed at 600° C. for 30 minutes and then cold-worked to be a sheet of 0.2 mm. thick and internally oxidized at 600° C. for 30 minutes in the atmosphere to obtain an electrical contact material of the present invention. Even by the producing method by the hot-extrusion, a uniform granular dispersion of Si and Ge of an average diameter of 0.5 μm could be obtained. As a result of investigating the contact resistance, it was found to be about 20 to 30 mΩ and showed a very stable characteristic.

EXAMPLE 12

Ingots of a diameter of 10 mm. and a length of 100 mm. were made by dissolving at 1,500° and 2,000° C. each of alloys of compositions shown in Table 6, surface-ground, then hot-worked at 600° C. to be a plate of 2 mm. thick and then cold-worked to be a contact piece of a diameter of 5 mm. and a thickness of 1 mm. This piece was internally oxidized at 800° C. for 30 minutes to obtain an electrical contact material according to the present invention. This electrical contact material was bonded by silver brazing to a Cu bar of a diameter of 5 mm. and a length of 10 mm. and thus prepared contact was opened and closed while passing an electric current of 30 A under an impressed voltage of 30 V. Six contacts of each sample were tested. The numbers of opening and closing operations until a half, that is, 3 of the electrical contacts have become unable to be opened due to welding are shown in Table 6.

TABLE 6

| Sample No. | Ag | Si | Au | Re | Ti | V | W | Ta | Mo | Nb | Zr | Number of Open'g & Clos'g Operations Until more than 50% of Contacts Welded. |
|---|---|---|---|---|---|---|---|---|---|---|---|---|
| 1 | 98 | 2 | — | 1 | — | — | — | — | — | — | — | $1.52 \times 10^4$ |
| 2 | 98 | 2 | — | — | 1 | — | — | — | — | — | — | $1.32 \times 10^4$ |
| 3 | 98 | 2 | — | — | — | 1 | — | — | — | — | — | $1.15 \times 10^4$ |
| 4 | 97 | 2 | 1 | — | — | — | 1 | — | — | — | — | $1.73 \times 10^4$ |
| 5 | 97 | 2 | 1 | — | — | — | — | 1 | — | — | — | $1.24 \times 10^4$ |
| 6 | 97 | 2 | 1 | — | — | — | — | — | 1 | — | — | $1.55 \times 10^4$ |
| 7 | 97 | 2 | 1 | — | — | — | — | — | — | 1 | — | $1.58 \times 10^4$ |
| 8 | 97 | 2 | 1 | — | — | — | — | — | — | — | 1 | $1.20 \times 10^4$ |
| 9 | 82 | 10 | 5 | 3 | — | — | — | — | — | — | — | $5.20 \times 10^5$ |

TABLE 6-continued

| Sample No. | Ag | Si | Au | Re | Ti | V | W | Ta | Mo | Nb | Zr | Number of Open'g & Clos'g Operations Until more than 50% of Contacts Welded. |
|---|---|---|---|---|---|---|---|---|---|---|---|---|
| 10 | 82 | 10 | 5 | — | — | — | — | — | — | — | — | $3.80 \times 10^5$ |
| 11 | 82 | 10 | 5 | — | — | — | — | — | — | — | — | $4.15 \times 10^5$ |
| 12 | 68 | 17 | 10 | 5 | — | — | — | — | — | — | — | $8.12 \times 10^5$ |
| 13 | 68 | 17 | 10 | — | 5 | — | — | — | — | — | — | $7.33 \times 10^5$ |
| 14 | 68 | 17 | 10 | — | — | 5 | — | — | — | — | — | $6.52 \times 10^5$ |
| 15 | 68 | 17 | 10 | — | — | — | 5 | — | — | — | — | $9.31 \times 10^5$ |
| 16 | 68 | 17 | 10 | — | — | — | — | 5 | — | — | — | $7.55 \times 10^5$ |
| 17 | 68 | 17 | 10 | — | — | — | — | — | 5 | — | — | $8.56 \times 10^5$ |
| 18 | 68 | 17 | 10 | — | — | — | — | — | — | 5 | — | $8.05 \times 10^5$ |
| 19 | 68 | 17 | 10 | — | — | — | — | — | — | — | 5 | $6.88 \times 10^5$ |

When the welding of contacts of Ag as well as the internally oxidized Ag—10% Si alloys was investigated, it was found that, within $10^3$ times of the contact opening and closing operations, 100% of them of Ag alone and 50% of those of the internally oxidized Ag—Si alloys showed troubles of inability to open due to welding. Therefore, the electrical contact material of the present invention was improved to be more than 10 times as high in the welding resistivity. These electrical contact materials maintained the sticking resistivity contact resistance property, erosion resistivity and corrosion resistivity.

EXAMPLE 13

Each of alloys of such compositions as shown in Table 7 was dissolved to be in the form of a button of a diameter of 20 mm. and a thickness of 5 mm. in an arc dissolving furnace, hot-worked at 600° C. to be a plate of 2 mm. thick and cold-working to be of a diameter of 5 mm. and a thickness of 1 mm. This sample was internaly oxidized at 700° C. and bonded by silver brazing to a copper bar as in Example 12, and the contact with this sample was opened and closed while passing an electric current of 40 A under an impressed voltage of 30 V to investigate the welding resistivity. As a result, it was found that 100% of the contacts of Ag as well as those of the internally oxidized Ag—10% at. % Si was welded in $10^3$ times, but those of the contact materials shown in Table 7 did not weld at all.

The number of opening and closing operations until 50% of the electrical contact materials according to the present invention welded was more than $10^4$ times as shown in Table 7 and they were high in the welding resistivity. These electrical contact materials also maintained the sticking resistivity, contact resistance property, erosion resistivity and corrosion resistivity.

TABLE 7

| Sample No. | Ag | Ge | Pd | Re | Ti | V | W | Ta | Mo | Nb | Zr | Number of Open'g & Clos'g Operations until more than 50% of Contacts Welded. |
|---|---|---|---|---|---|---|---|---|---|---|---|---|
| 20 | 96 | 2 | 1 | 1 | — | — | 1 | — | — | — | — | $2.05 \times 10^4$ |
| 21 | 96 | 2 | 1 | — | 1 | — | — | 1 | — | — | — | $2.55 \times 10^4$ |
| 22 | 83 | 10 | 5 | — | — | 1 | — | — | 1 | — | — | $4.35 \times 10^5$ |
| 23 | 83 | 10 | 5 | — | — | — | — | — | — | 1 | 1 | $5.20 \times 10^5$ |
| 24 | 71 | 17 | 10 | 2 | — | — | — | — | — | — | — | $8.33 \times 10^5$ |
| 25 | 71 | 17 | 10 | — | — | — | — | — | 2 | — | — | $9.21 \times 10^5$ |

EXAMPLE 14

An ingot of a diameter of 10 mm. and a length of 100 mm. was made by dissolving, at 1,200° to 1,500° C. each of such alloys of different compositions as shown in Table 8, this ingot was surface-ground, hot-worked at 600° C. to be a material of a thickness of 2 mm. and then cold-worked to be a sheet of 150 μm. This sheet was internally oxidized at 800° C. for 1 hour in the atmosphere and mounted on a wire spring relay. Discharges were caused while this electrical contact material was closed in an RC discharge circuit ($R=20\Omega$ and $C=0.22$ μF) under an impressed voltage of 48 V. The erosion depth after 100 thousand times of opening and closing operations is shown in Table 8.

TABLE 8

| Sample No. | Composition of Alloy (at. %) | Erosion Depth (μm) |
|---|---|---|
| 1 | Ag - 2Si | 50 ± 20 |
| 2 | Ag - 2Si - 1Fe | 26 ± 5 |
| 3 | Ag - 2Si - 1Ni | 25 ± 5 |
| 4 | Ag - 2Si - 1Co | 22 ± 5 |
| 5 | Ag - 2Si - 1Cu | 27 ± 5 |
| 6 | Ag - 7Si | 30 ± 5 |
| 7 | Ag - 7Si - 3Fe | 15 ± 5 |
| 8 | Ag - 7Si - 3Ni | 17 ± 5 |
| 9 | Ag - 7Si - 3Co | 18 ± 5 |
| 10 | Ag - 7Si - 3Cu | 11 ± 5 |
| 11 | Ag - 7Si - 5Au | 30 ± 5 |
| 12 | Ag - 7Si - 5Au - 3Fe | 10 ± 5 |
| 13 | Ag - 7Si - 5Au - 3Co | 10 ± 5 |
| 14 | Ag - 7Si - 5Au - 3Ni | 8 ± 5 |
| 15 | Ag - 7Si - 5Au - 3Cu | 7 ± 5 |
| 16 | Ag - 17Si - 5Au | 10 ± 5 |
| 17 | Ag - 17Si - 5Au - 5Fe | 5 ± 2 |
| 18 | Ag - 17Si - 5Au - 5Co | 5 ± 2 |
| 19 | Ag - 17Si - 5Au - 5Ni | 5 ± 2 |
| 20 | Ag - 17Si - 5Au - 5Cu | 5 ± 2 |
| 21 | Ag - 17Si - 10Au - 5Ni | 5 ± 2 |
| 22 | Ag - 17Si - 10Au - 5Cu | 3 ± 1 |

As seen in Table 8, the effects of adding Fe, Ni, Co and Cu on the erosion resistivity are apparent.

Even by the addition of Fe, Co, Ni and Cu, these electrical contact materials maintained the sticking resistivity, contact resistance property and corrosion resistivity.

EXAMPLE 15

A sheet of a thickness of 150 μm was made by dissolving each of such alloys of different compositions as shown in Table 9. The sheet was internally oxidized at 700° C. for 1 hour in the atmosphere and was then mounted on a wire spring relay. Discharges were caused while this electrical contact material was closed by using a coaxial cord of 5D2V of a length of 20 m. as a load under an impressed voltage of 100 V. The anode erosion depth after the contact opening and closing operations of 2 million times is shown in Table 9. By the addition of each of Fe, Co, Ni and Cu, the erosion depth was improved to 2 to 3 times as low.

TABLE 9

| Sample No. | Composition of Alloy (at. %) | Erosion Depth (μm) |
|---|---|---|
| 23 | Ag - 10Ge | 20 ± 5 |
| 24 | Ag - 10Ge - 10Pd | 20 ± 5 |
| 25 | Ag - 10Ge - 10Pd - 5Fe | 5 ± 3 |
| 26 | Ag - 10Ge - 10Pd - 5Co | 5 ± 3 |
| 27 | Ag - 10Ge - 10Pd - 5Ni | 3 ± 3 |
| 28 | Ag - 10Ge - 10Pd - 5Cu | 3 ± 3 |

These electrical contact materials maintained also the sticking resistivity, contact resistance property and corrosion resistivity.

According to the present invention, as has been described in the foregoing, silver employed as the basic metal and Si or Ge or both, optionally with at least one additive element selected properly for providing to silver the respective desired characteristics as being the electrical contact material, are melted, quenched, and then plastically worked so that Si or Ge or both will be uniformly dispersed in the basic metal in the form of fine crystals, and thereafter thus obtained alloy is subjected to the internal oxidization treatment of such fine crystals, whereby an improved electrical contact material of silver eutectic alloy system in which the uniform dispersion of the internally oxidized fine crystals is maintained is obtained.

What is claimed is:

1. A method of producing an electrical contact material comprising a silver eutectic alloy comprising Ag as the main component in which fine oxide particles are uniformly dispersed, said method comprising the steps of:

(a) admixing with Ag at least one element selected from the group consisting of Si and Ge;
(b) melting said admixture of Ag and said at least one element to form an alloy;
(c) quenching said alloy;
(d) annealing said quenched alloy in a vacuum;
(e) plastically working said annealed alloy; and
(f) internally oxidizing said plastically worked alloy.

2. The method according to claim 1 wherein said at least one element is present in a concentration of 1 to 17 at. % based on the weight of the material.

3. The method according to claim 1 wherein said at least one element comprises Si, and said alloy is internally oxidized at a temperature of 250° to 840° C.

4. The method according to claim 1 wherein said at least one element comprises Si, and said alloy is internally oxidized at a temperature of 250° to 651° C.

5. The method according to claim 1 wherein said at least one element comprises Si and Ge, and said alloy is internally oxidized at a temperature of 250° to 840° C.

6. A method of producing an electrical contact material comprising a silver eutectic alloy comprising Ag as the main component in which fine oxide particles are uniformly dispersed, said method comprising the steps of:

(a) admixing with Ag at least one element selected from the group consisting of Si and Ge and at least one additional element selected from at least one of the following groups wherein:
the first group consists of Au, Pt, Pd, Rh, Ru, Os and Ir, and
the second group consists of Ti, V, Zr, Nb, Mo, Ta, W and Re, and the third group consists of Fe, Co, Ni and Cu;
(b) melting said admixture of Ag and said elements to form an alloy;
(c) quenching said alloy;
(d) annealing said quenched alloy in a vacuum;
(e) plastically working said annealed alloy; and
(f) internally oxidizing said plastically worked alloy.

7. The method according to claim 6 wherein said at least one element is present in a concentration of 1 to 17 at. % based on the weight of the material.

8. The method according to claim 6 wherein said at least one element is present in a concentration of 1 to 17 at. % and said at least one additional element selected from said first group is present in a concentration of 1 to 10 at. % based on the weight of the material.

9. The method according to claim 6 wherein said at least one element is present in a concentration of 1 to 17 at. % and said at least one additional element selected from said second group is present in a concentration of 1 to 5 at. % based on the weight of the material.

10. The method according to claim 6 wherein said at least one element is present in a concentration of 1 to 17 at. % and said at least one additional element selected from said third group is present in a concentration of 1 to 5 at. % based on the weight of the material.

11. The method according to claim 6 wherein said at least one element is present in a concentration of 1 to 17 at. % and said at least one additional element selected from said first group is present in a concentration of 1 to 10 at. % and said at least one additional element selected from said second group is present in a concentration of 1 to 5 at. % based on the weight of the material.

12. The method according to claim 6 wherein said at least one element is present in a concentration of 1 to 17 at. % and said at least one additional element selected from said first group is present in a concentration of 1 to 10 at. % and said at least one additional element selected from said third group is present in a concentration of 1 to 5 at. % based on the weight of the material.

13. The method according to claim 6 wherein said at least one element comprises Si, and said alloy is internally oxidized at a temperature of 250° to 840° C.

14. The method according to claim 6 wherein said at least one element comprises Ge, and said alloy is internally oxidized at a temperature of 250° to 651° C.

15. The method according to claim 6 wherein said at least one element comprises Si and Ge, and said alloy is internally oxidized at a temperature of 250° to 840° C.

16. The method according to claim 1 wherein said melting step is performed at a temperature of 1,100° to 1,200° C.

17. The method according to claim 6 wherein said melting step is performed at a temperature of 1,100° to 2,000° C.

18. The method according to claim 1 wherein said annealing step is performed at a temperature of 300° to 800° C. for a period of time ranging from 20 to 60 minutes, and said plastically working step is performed at a temperature of 300° to 600° C.

19. The method according to claim 6 wherein said annealing step is performed at a temperature of 300° to 800° C. for a period of time ranging from 20 to 60 minutes, and said plastically working step is performed at a temperature of 300° to 600° C.

* * * * *